US009222346B1

(12) United States Patent
Walls

(10) Patent No.: US 9,222,346 B1
(45) **Date of Patent: *Dec. 29, 2015**

(54) HYDRAULIC FRACTURING SYSTEM AND METHOD

(71) Applicant: Gary C. Walls, Clymer, PA (US)

(72) Inventor: Gary C. Walls, Clymer, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/515,896

(22) Filed: Oct. 16, 2014

(51) Int. Cl.

| | |
|---|---|
| ***E21B 43/26*** | (2006.01) |
| ***E21B 33/03*** | (2006.01) |
| ***E21B 44/00*** | (2006.01) |
| *E21B 43/00* | (2006.01) |
| *E21B 28/00* | (2006.01) |

(52) U.S. Cl.
CPC ..... *E21B 43/26* (2013.01); *E21B 33/03* (2013.01); *E21B 44/00* (2013.01); *E21B 28/00* (2013.01); *E21B 43/003* (2013.01)

(58) Field of Classification Search
CPC ..... E21B 43/26; E21B 33/068; E21B 43/003; E21B 28/00
See application file for complete search history.

(56) References Cited

U.S. PATENT DOCUMENTS

| | | | | |
|---|---|---|---|---|
| 2,915,122 | A | 12/1959 | Hulse | |
| 3,020,720 | A * | 2/1962 | Spalding | 60/532 |
| 3,602,311 | A * | 8/1971 | Whitsitt | 166/308.1 |
| 3,765,804 | A * | 10/1973 | Brandon | 417/540 |
| 3,981,624 | A * | 9/1976 | Brandon | 417/53 |
| 4,049,056 | A | 9/1977 | Godfrey | |
| 4,548,252 | A | 10/1985 | Stowe et al. | |
| 4,714,114 | A | 12/1987 | Jones | |
| 5,836,393 | A | 11/1998 | Johnson | |
| 7,559,373 | B2 | 7/2009 | Jackson et al. | |
| 7,568,525 | B2 | 8/2009 | Veselkov | |
| 7,568,528 | B1 | 8/2009 | Miller et al. | |
| 7,810,520 | B2 | 10/2010 | Perratone et al. | |
| 7,836,948 | B2 | 11/2010 | Kusko et al. | |
| 8,061,421 | B2 | 11/2011 | Samaroo et al. | |
| 8,220,537 | B2 | 7/2012 | Leon et al. | |
| 8,225,856 | B2 | 7/2012 | Kerfoot | |
| 8,347,965 | B2 | 1/2013 | Spence et al. | |
| 8,714,257 | B2 | 5/2014 | Kitzman | |
| 8,789,601 | B2 | 7/2014 | Broussard et al. | |

* cited by examiner

*Primary Examiner* — Nicole Coy
(74) *Attorney, Agent, or Firm* — K&L Gates LLP

(57) ABSTRACT

A hydraulic fracturing system and method are disclosed. The system can include a manifold having a first fluid outlet, a second fluid outlet, and a plurality of fluid inlets. The system can also include primary pumps, which are fluidically coupled to one of the fluid inlets, wherein the primary pumps are configured to deliver a first fluid stream to the first fluid outlet and a second fluid stream to the second fluid outlet. The system can further include a supplemental pump fluidically coupled to the second fluid outlet, wherein the supplemental pump is configured to deliver pulses of fluid to the first fluid stream.

19 Claims, 8 Drawing Sheets

HYDRAULIC FRACTURING SYSTEM AND METHOD

FIELD

The present disclosure relates to hydraulic fracturing systems and methods for assembling and using the same.

BACKGROUND

Hydraulic fracturing can be used to stimulate and/or increase production from oil and gas wells. In a hydraulic fracturing process, fracturing fluid is pumped into a wellbore. Inside the wellbore, hydraulic pressure is employed to force the fracturing fluid into a formation. When the fracturing fluid enters the formation, the formation can fracture and channels and/or fissures can be created within the formation. Fracturing fluid can be pumped into the fractured formation to expand the fissures and/or to increase the size and/or quantity of fissures in the formation. The fracturing fluid can include water, chemicals, and proppants, such as sand, metal, and/or glass beads, for example, which can hold the fissures open. Because hydraulic fracturing can create fissures within a formation and can hold the fissures open, hydraulic fracturing can stimulate the release of oil and gas from the formation.

The equipment, including the pump(s), conduit(s), and/or manifold(s), for example, utilized in a hydraulic fracturing operation can operate up to and/or be rated to operate below a pressure threshold or maximum pressure $P_{max}$. In certain instances, the maximum pressure $P_{max}$ can be limiting factor in a hydraulic fracturing operation. For example, when a hydraulic fracturing system is operated at its maximum pressure ($P_{max}$), significant volumes of oil and/or gas may remain in the well. In such instances, it can be desirable to improve the effectiveness of a hydraulic fracturing operation, such that additional volumes of gas and/or oil can be extracted from the well, while operating below the maximum pressure ($P_{max}$) of the equipment.

Additionally, it can be desirable to extract gas and/or oil from the well using less water and/or less fracturing fluids, with reduced horsepower requirements and/or reduced emissions, and/or in fewer stages and/or more quickly. Additionally, it can be desirable to utilize hydraulic fracturing processes in expanded and/or additional areas. It can also be desirable to reduce the costs of hydraulic fracturing operations, reduce the static pressure required to fracture the formations and/or force the fracturing fluid into the formations, and/or improve the safety conditions at a hydraulic fracturing site. Moreover, it can be desirable to provide real time feedback information to the operators of the hydraulic fracturing equipment.

The foregoing discussion is intended only to illustrate various aspects of the related art in the field at the time and should not be taken as a disavowal of claim scope.

SUMMARY

In at least one form, a hydraulic fracturing system comprises a manifold comprising a first fluid outlet, a second fluid outlet, and a plurality of fluid inlets. The hydraulic fracturing system further comprises a plurality of primary pumps, wherein each of the primary pumps is fluidically coupled to one of the fluid inlets, wherein the primary pumps are configured to deliver a first fluid stream to the first fluid outlet, and wherein the primary pumps are configured to deliver a second fluid stream to the second fluid outlet. The hydraulic fracturing system further comprises a supplemental pump fluidically coupled to the second fluid outlet, wherein the supplemental pump is configured to deliver pulses of fluid to the first fluid stream.

In at least one form, the manifold further comprises a supplemental inlet that is fluidically coupled to the supplemental pump. In at least one form, the hydraulic fracturing system further comprises a conduit extending from the first outlet to a wellhead. Additionally, in at least one form, the supplemental pump is fluidically coupled to the conduit. Moreover, in at least one form, the supplemental pump is fluidically coupled to the wellhead.

In at least one form, the supplemental pump comprises a first supplemental pump, wherein the hydraulic fracturing system further comprises a second supplemental pump fluidically coupled to the second fluid outlet, and wherein the second supplemental pump is configured to deliver pulses of fluid to the first fluid stream. Additionally, in at least one form, the hydraulic fracturing system further comprises a controller in signal communication with the first supplemental pump and the second supplemental pump. Moreover, in at least one form, the first supplemental pump is configured to deliver pulses of a first magnitude at a first frequency, and the second supplemental pump is configured to deliver pulses of a second magnitude at a second frequency. In at least one form, the first magnitude is different than the second magnitude. In at least one form, the first frequency is different than the second frequency.

In at least one form, the fluid stream comprises hydraulic fracturing fluid. In at least one form, each primary pump comprises a piston pump. In at least one form, the hydraulic fracturing system further comprising a plurality of motors operably coupled to the primary pumps and the supplemental pump.

In at least one form, a hydraulic fracturing system comprises a manifold comprising a first fluid outlet, a second fluid outlet, and a fluid inlet. The hydraulic fracturing system further comprises a primary pump fluidically coupled to the fluid inlet, wherein the primary pump is configured to deliver a fluid stream to the manifold, wherein a first portion of the fluid stream is directed toward the first fluid outlet, and wherein a second portion of the fluid stream is directed toward the second fluid outlet. The hydraulic fracturing system further comprises a supplemental pump fluidically coupled to the second fluid outlet, wherein the supplemental pump is configured to receive the second portion of the fluid stream and generate pulses of fluid in the second portion of the fluid stream, and wherein the pulses are delivered to the first portion of the fluid stream. The hydraulic fracturing system also comprises a controller in signal communication with the supplemental pump, wherein the controller is configured to control the pulses of fluid from the supplemental pump.

In at least one form, the supplemental pump comprises a first supplemental pump, wherein the hydraulic fracturing system further comprises a second supplemental pump arranged in parallel with the first supplemental pump. Additionally, in at least one form, the hydraulic fracturing system further comprises a controller in signal communication with the first supplemental pump and the second supplemental pump. Moreover, in at least one form, the first supplemental pump is configured to deliver pulses of a first magnitude at a first frequency, and the second supplemental pump is configured to deliver pulses of a second magnitude at a second frequency. In at least one form, the first magnitude is different than the second magnitude, and the first frequency is different than the second frequency.

In at least one form, a hydraulic fracturing method comprises, generating a fluid stream from a primary pumping system, directing a first portion of the fluid stream to a primary fluid path, diverting a second portion of the fluid stream to a supplemental fluid path, generating a pulsed output from the second portion of the fluid stream, and directing the pulsed output into the first portion of the fluid stream upstream of a wellhead.

In at least one form, the hydraulic fracturing method further comprises controlling a supplemental pumping system that is configured to generate the pulsed output from the second portion of the fluid stream.

BRIEF DESCRIPTION OF THE DRAWINGS

Various features and advantages and the manner of attaining them will become more apparent and will be better understood by reference to the following description of embodiments in conjunction with the accompanying drawings, in which.

DETAILED DESCRIPTION

Certain exemplary embodiments will now be described to provide an overall understanding of the principles of the structure, function, manufacture, and use of the devices, systems, and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments is defined solely by the claims. The features illustrated or described in connection with one exemplary embodiment may be combined with the features of other embodiments. Such modifications and variations are intended to be included within the scope of the present disclosure.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment", or "in an embodiment", or the like, in places throughout the specification are not necessarily all referring to the same embodiment. Additionally, reference throughout the specification to "various instances," "some instances," "one instance," or "an instance", or the like, means that a particular feature, structure, or characteristic described in connection with the instance is included in at least one instance. Thus, appearances of the phrases "in various instances," "in some instances," "in one instance", "in an instance", or the like, in places throughout the specification are not necessarily all referring to the same instance.

Furthermore, the particular features, structures, or characteristics may be combined in any suitable manner in one or more embodiment or instance. Thus, the particular features, structures, or characteristics illustrated or described in connection with one embodiment or instance may be combined, in whole or in part, with the features structures, or characteristics of one or more other embodiment or instance without limitation. Such modifications and variations are intended to be included within the scope of the present disclosure.

Figure 1:
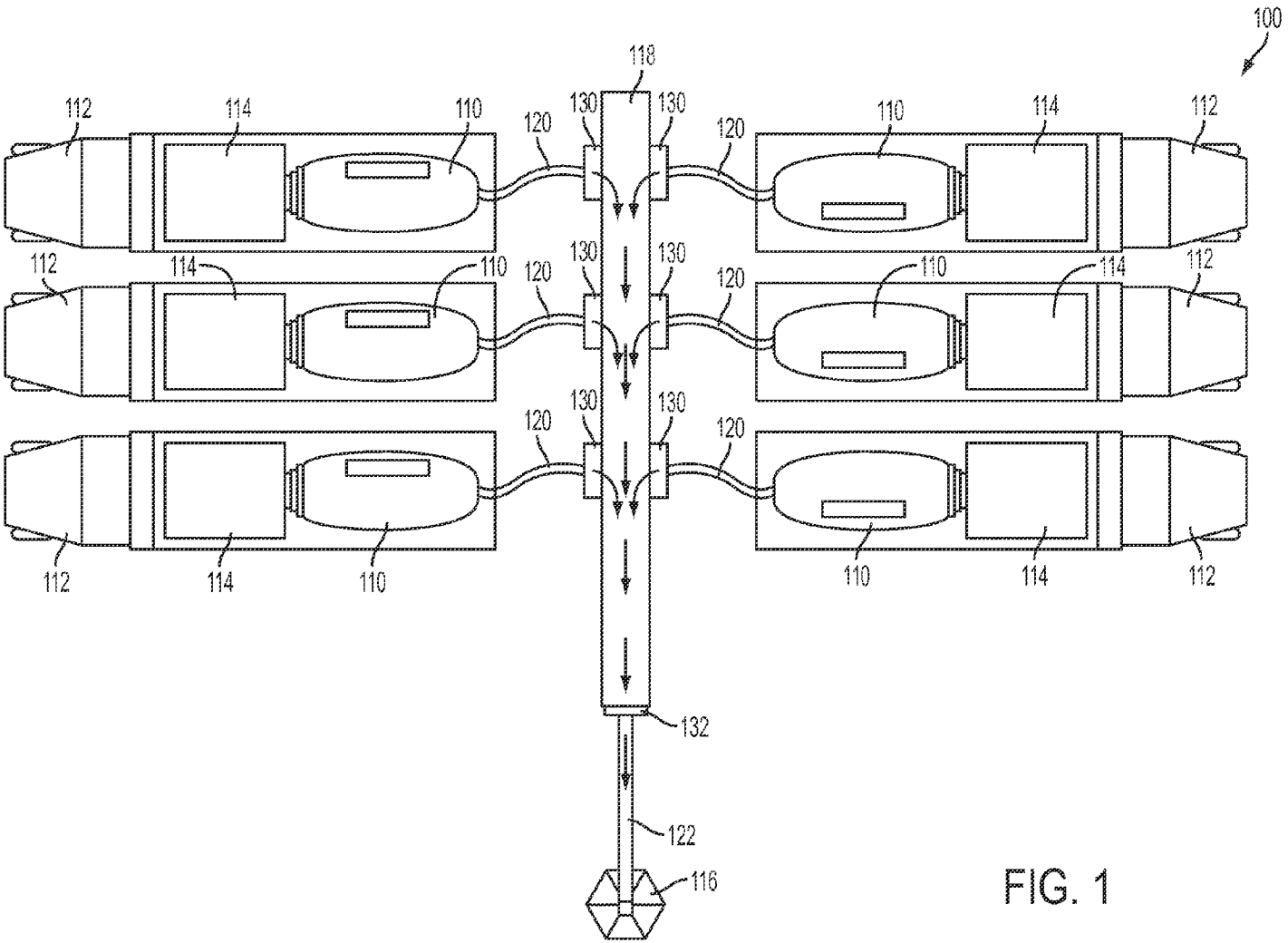
FIG. 1 is a schematic depicting a hydraulic fracturing system that includes a plurality of primary pumps, a manifold operably in fluid communication with the primary pumps, and a wellhead operably in fluid communication with the manifold, according to various embodiments of the present disclosure.

FIG. 1 is a schematic depicting a hydraulic fracturing system 100. The depicted hydraulic fracturing system 100 includes multiple primary pumps 110 in fluid communication with a manifold 118. The depicted manifold 118 is operably configured to be in fluid communication with a wellhead 116. In the depicted arrangement, the primary pumps 110 are configured to pump fluid and supply the pumped fluid to the wellhead 116 via the manifold 118, as well as various additional conduits and/or fluid lines, which are described in greater detail herein.

The primary pumps 110 can be high-pressure, high-volume fracturing pumps. In certain instances, the primary pumps 110 can be piston pumps. For example, the pumps 110 can be triplex or quintuplex piston pumps. The primary pumps 110 can be rated up to 22,000 psi and 115 gallons per minute, for example. At a lower value psi, the primary pumps 100 can be rated up to 1375 gallons per minute, for example.

In various instances, the primary pumps 110 can be portable or mobile, for example. For example, each primary pump 110 can be mounted to a vehicle 112, such as a truck or a trailer, for example. In certain instances, the primary pumps 110 can be moved around the hydraulic fracturing site and/or can be relocated to different hydraulic fracturing sites. In some instances, multiple primary pumps 110 can be mounted to each vehicle 112. Referring to FIG. 1, the hydraulic fracturing system 100 can include six (6) primary pumps 110. In other instances, the hydraulic fracturing system 100 can include less than six (6) primary pumps 110 or more than six (6) primary pumps 110. For example, the hydraulic fracturing system 100 can include a single primary pump 110, or seven (7) or more primary pumps 110.

Referring still to FIG. 1, the primary pumps 110 can be powered by motors 114. The motors 114 can also be mounted to the vehicles 112, for example. In other instances, the motors 114 can be independent of the vehicles 112. In various instances, the motors 114 can be diesel-powered motors, for example. An exemplary, non-limiting motor is the Caterpillar 3516C High Displacement marine engine, for example.

The primary pumps 110 can be fluidically connected to the wellhead 116 via fluid lines 120, the manifold 118, and/or a conduit 122. For example, the vehicles 112 can be positioned near enough to the manifold 118 such that a fluid line 120 connects each primary pump 110 to the manifold 118. The manifold 118 can include a plurality of inlets 130 and an outlet 132. In certain instances, the inlets 130 can be equally-spaced along the length of the manifold 118. In other instances, at least two inlets 130 can be unequally spaced. Additionally or alternatively, an inlet 130 can be positioned at an end of the manifold 118. Referring to the embodiment depicted in FIG. 1, the manifold 118 includes six (6) inlets 130, and each inlet 130 is coupled to a fluid line 120. In other instances, the manifold 118 can include additional inlets 130, which may be used in certain operations and may remain unused in other operations. In various instances, the outlet 132 can be positioned at an end of the manifold 118. In other instances, the outlet 132 can be positioned along the length thereof and/or can be between two inlets 130. Referring to the embodiment depicted in FIG. 1, the manifold 118 includes a single outlet 132.

Fracturing fluid can flow along a fluid path or stream within the manifold 118. Referring to FIG. 1, a fluid path is indicated by the arrows. For example, fracturing fluid can enter the manifold 118 at the inlets 130 along the length of the manifold 118, and can flow toward the outlet 132. Additionally, the manifold 118 can be connected to the wellhead 116 by a fluid line or conduit 122. The conduit 122 can be configured to deliver the fracturing fluid from the manifold 118 to the wellhead 116. The manifold 118 and conduit 122 can be rated to withstand high pressures.

Various components of fracturing fluid can be supplied to the primary pumps 110. For example, water, chemicals, and/or proppants can be supplied to one or more of the primary pumps 110. In certain instances, the hydraulic fracturing fluid supplied to the primary pumps 110 can be pre-mixed. For example, a slurry blender can mix various components, and the mixture can be fed into one or more of the primary pumps 110. In some instances, at least one primary pump 110 in the system 100 can be coupled to a water supply, at least one primary pump 110 in the system 100 can be coupled to a chemical supply, and/or at least one pump 110 in the system can be coupled to a proppant supply. For example, referring to FIG. 1, five (5) of the primary pumps 110 can supply water and chemicals to the manifold 118, and one (1) of the primary pumps 110 can supply proppants to the manifold 118.

Proppants can include sand, metal and/or glass beads, and/or other solid material, for example. The proppants can be various sizes, and multiple different size proppants can be included in a hydraulic fracturing fluid. Chemical additives can include lubricants, for example. In various instances, chemical additives and/or proppants can comprise approximately 0.5% of the total volume of fracturing fluid delivered to the wellhead 116.

The hydraulic fracturing system 100 may also include blenders or mixers, which can be configured to mix and blend the components of the hydraulic fracturing fluid, and to supply the hydraulic fracturing fluid to the primary pumps 110. Water, chemicals, and/or proppants can be supplied to the system 100 by additional vehicles, conduits, and/or conveyors. The hydraulic fracturing system 100 can further include at least one monitoring unit, which can monitor the composition and properties of the fracturing fluid, the volume of various supplies, and/or the flow rate, density, and/or pressure of the fracturing fluid at various locations within the system 100.

Referring still to FIG. 1, the primary pumps 110, which supply fracturing fluid components and/or the fracturing fluid to the manifold 118, can be configured and/or designed to supply a constant flow rate and uniform pressure into the wellbore 116. For example, an operator can control the primary pumps 110 to supply a relatively constant flow rate and pressure. As a result, the flow rate and pressure of the fracturing fluid exiting the manifold 118 can be constant or substantially constant.

In certain instances, the generation and introduction of pulses or waves of fracturing fluid into the fluid stream can improve the effectiveness of the hydraulic fracturing operation. For example, pulses of fracturing fluid can create additional fissures within a formation and/or can enlarge preexisting fractures. More specifically, pulses of fracturing fluid can force a proppant, such as sand, for example, further down the borehole and into the formation to further enlarge the width and/or extend the length of the fissure and to hold the fissure open. Because pulses of fracturing fluid can expand the fractured region, the addition of pulses to a fracturing operation can generate more oil and/or gas from the well. The addition of pulses can also extend hydraulic fracturing to areas where it would otherwise be cost prohibitive.

A pulse of fracturing fluid can also provide a pressure shock signal to the operator. For example, microseismic energy measurement device(s) at the surface can measure the microseismic events and/or conditions within and around the wellbore. The device can then communicate the measurements to the operator in real time.

The pulses of fracturing fluid within the fluid stream can be mechanically induced. For example, a supplemental pump can generate a mechanical pulse or wave of fracturing fluid, which can be fed into the fluid stream. In certain instances, the supplemental pump can provide periodic pulses, for example, which can generate corresponding periodic pressure increases or spikes within the fluid stream. In other instances, the pulses can be intermittent and/or sporadic. An operator can control the supplemental pump to deliver pulses periodically and/or sporadically, for example.

In certain instances, multiple supplemental pumps can be configured to generate pulses of fracturing fluid, which can be delivered to the fluid stream. The pulses can be output from different supplemental pumps and can have different frequencies and/or different amplitudes, for example. In various instances, the pulses from different supplemental pumps can overlap, and/or can concurrently join the fluid stream. In other instances, the pulses can be staggered and/or can intermittently join the fluid stream. In certain instances, at least one supplemental pump can be configured to deliver small pulses to the fluid stream, and at least one supplemental pump can be configured to deliver larger pulses to the fluid stream.

Large pulses of fracturing fluid can break apart rock formations, thus providing more channels and/or fissures within the formation. Additionally, large pulses of fracturing fluid can stimulate proppants and lubricants in the fracturing fluid, and can force additional proppants and lubricants within the fissures. Large pulses of fracturing fluid can also increase abrasion within the fissures, which can further enlarge a fissure. Moreover, large pulses of fracturing fluid can provide a shock signal to the operator.

Small pulses of fracturing fluid can also stimulate proppants in the fracturing fluid, which can force additional proppants within the fissures. As proppants are forced further into the fissures, the fissures can be enlarged. Additionally, the small pulses of fracturing fluid can also provide a shock signal to the operator.

Figure 2:
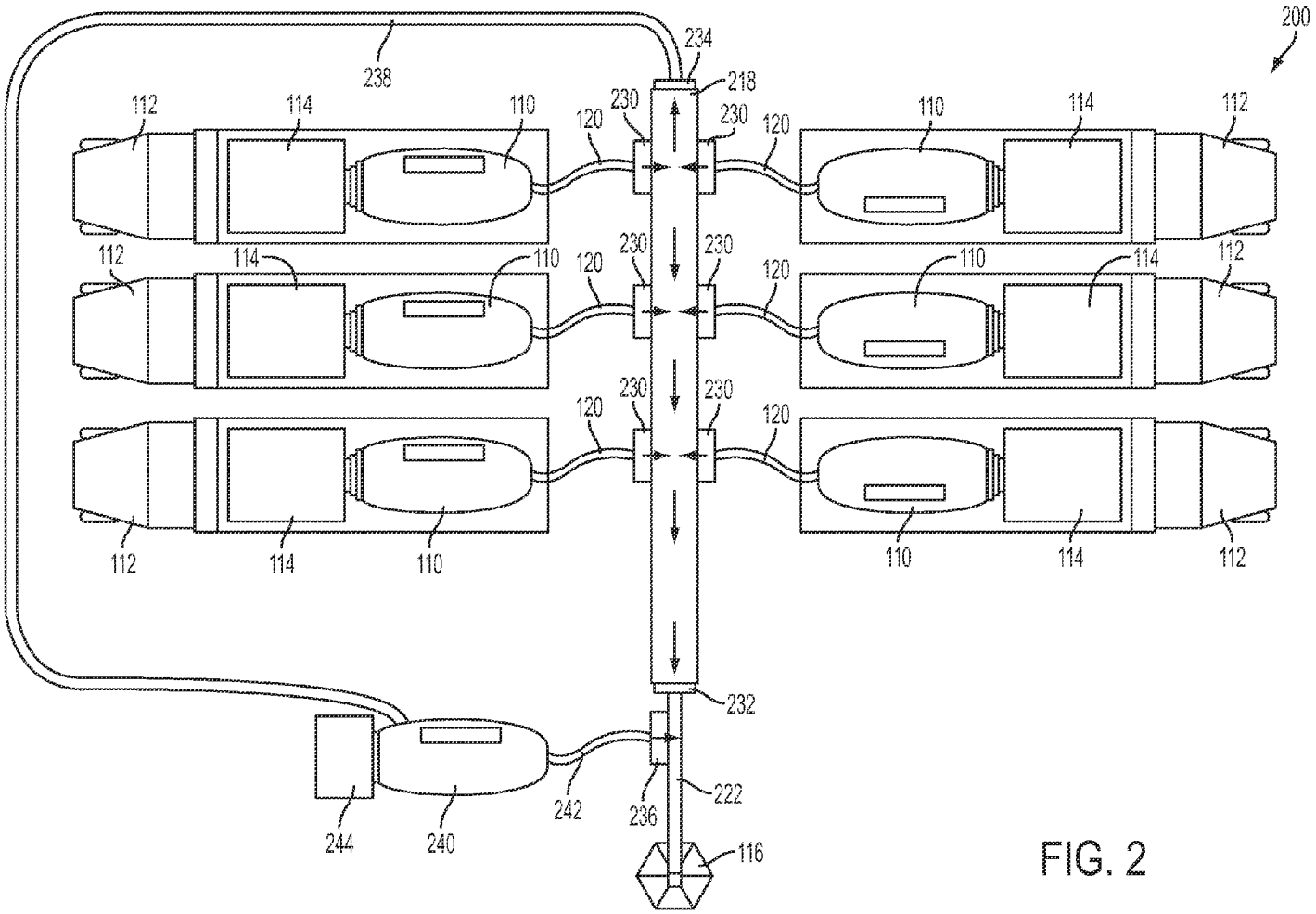
FIG. 2 is another schematic depicting a hydraulic fracturing system that includes the primary pumps and the wellhead of FIG. 1, and further includes a supplemental pump and a manifold, further depicting the manifold operably in fluid communication with the supplemental pump and with the primary pumps, according to various embodiments of the present disclosure.

Referring now to FIG. 2, a hydraulic fracturing system 200 is depicted. Similar to the system 100, the hydraulic fracturing system 200 includes the primary pumps 110, the motors 114, the vehicles 112, the fluid lines 120 extending from the primary pumps 110, and the wellhead 116. The hydraulic fracturing system 200 also includes a manifold 218 and a supplemental pump 240, which can be coupled to and/or driven by a power unit and/or motor 244.

Referring still to FIG. 2, the manifold 218 includes a plurality of inlets 230, which are coupled to the fluid lines 120. Accordingly, the fluid lines 120 permit fluid communication between the pumps 110 and the manifold 218. The manifold 218 depicted in FIG. 2 also includes a primary outlet 232, which is coupled to a primary conduit 222. The primary conduit 222 extends between the manifold 218 and the wellhead 116, and can operably permit a fluid stream to flow from the manifold 218 to the wellhead 116. Similar to the hydraulic fracturing system 100, the primary pumps 110 can supply a constant flow rate and uniform pressure into the manifold 218. As a result, the flow rate and pressure of the fracturing fluid exiting the manifold 218 can be constant or substantially constant.

The supplemental pump 240 can be in fluid communication with the manifold 218 via a supplemental outlet 234 to the manifold 218 and a supplemental conduit 238. For example, a first portion of the fluid stream that is injected or pumped into the manifold 218 from the primary pumps 110 via the fluid lines 120 can flow from the inlets 230 toward the primary outlet 232. Additionally, a second portion of the fluid stream that is injected or pumped into the manifold 218 from the primary pumps 110 can be diverted to the supplemental outlet 234. The second portion of the fluid stream can flow to the supplemental pump 240, for example.

In various instances, the supplemental pump 240 can be configured to induce at least one pulse of fluid into the fluid stream. For example, the supplemental pump 240 can generate a pulse of fracturing fluid, which can flow from the pump 240 through a connecting conduit 242. Thereafter, the mechanically-induced pulse of fluid can join the fluid stream generated by the primary pumps 110.

The mechanically-induced pulse or pulses generated by the supplemental pump 240 can be generated outside of the wellbore, for example, and can be transmitted to the fluid stream outside of the wellbore, for example. In various instances, the pulse or pulses can enter the fluid stream downstream of the plurality of inlets 230 to the manifold 218. For example, the pulses can be introduced to the fluid stream between the manifold 218 and the wellhead 116. In various instances, the supplemental pump 240 can transmit the mechanically-induced pulses to the connecting conduit 242, and the connecting conduit 242 can be coupled to the primary conduit 222. For example, the connecting conduit 242 and the primary conduit 222 can be coupled at a supplemental manifold or union intermediate the manifold 218 and the wellhead 116.

Figure 3:
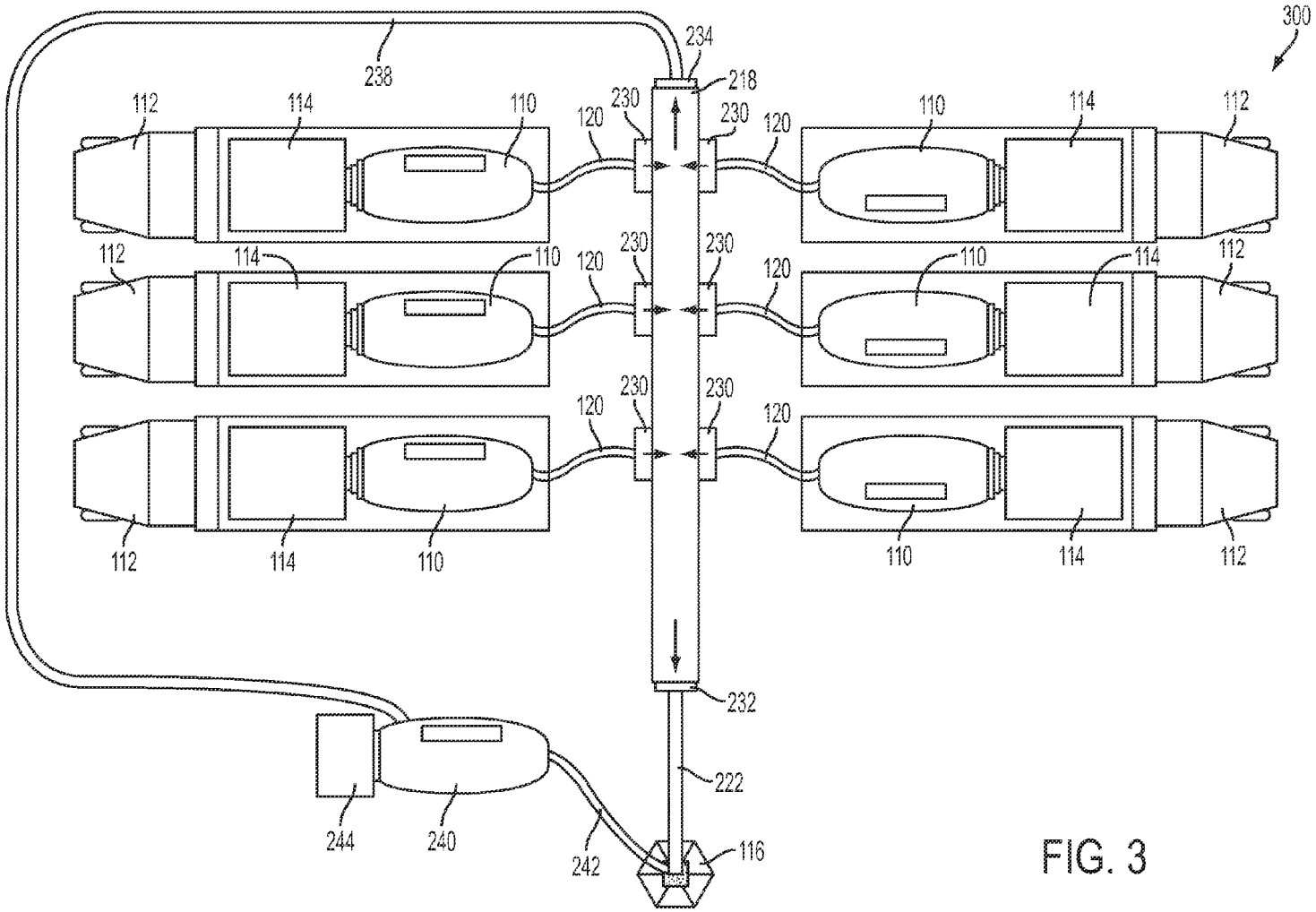
FIG. 3 is another schematic depicting a hydraulic fracturing system that includes the primary pumps and the wellhead of FIG. 1, and further includes the supplemental pump and the manifold of FIG. 2, according to various embodiments of the present disclosure.

In other instances, a supplemental, pulse-generating pump can transmit the pulse or pulses to the fluid stream at the wellhead 116. For example, referring to FIG. 3, a hydraulic fracturing system 300 is depicted. The hydraulic fracturing system 300 can be similar to the hydraulic fracturing system 200, except the connecting conduit 242 can extend between the supplemental pump 240 and the wellhead 116. In such instances, the mechanically-induced pulse(s) from the supplemental pump 240 can be transmitted to the stream of fracturing fluid entering the wellhead 116.

In still other instances, a supplemental, pulse-generating pump can transmit the pulse or pulses to the fluid stream within the manifold. For example, referring to FIG. 4, a hydraulic fracturing system 400 is depicted. The hydraulic fracturing system 400 can be similar to the hydraulic fracturing system 200. Additionally, the hydraulic fracturing system 400 can include a manifold 418 having a plurality of inlets 430 in fluid communication with the primary pumps 110 via the fluid lines 120. The manifold 418 can also include a primary outlet 432 in fluid communication with the wellhead 116 and a supplemental outlet 434 in fluid communication with the supplemental pump 240, which can be coupled to and/or driven by a power unit and/or motor 244. The manifold 418 depicted in FIG. 4 further includes a supplemental inlet 436 downstream of the primary inlets 430. In the depicted arrangement, the connecting conduit 242 extends between the supplemental pump 240 and the supplemental inlet 436 such that the pulse or pulses generated by the supplemental pump 240 are directed into the fluid stream at the manifold 418.

Figure 4:
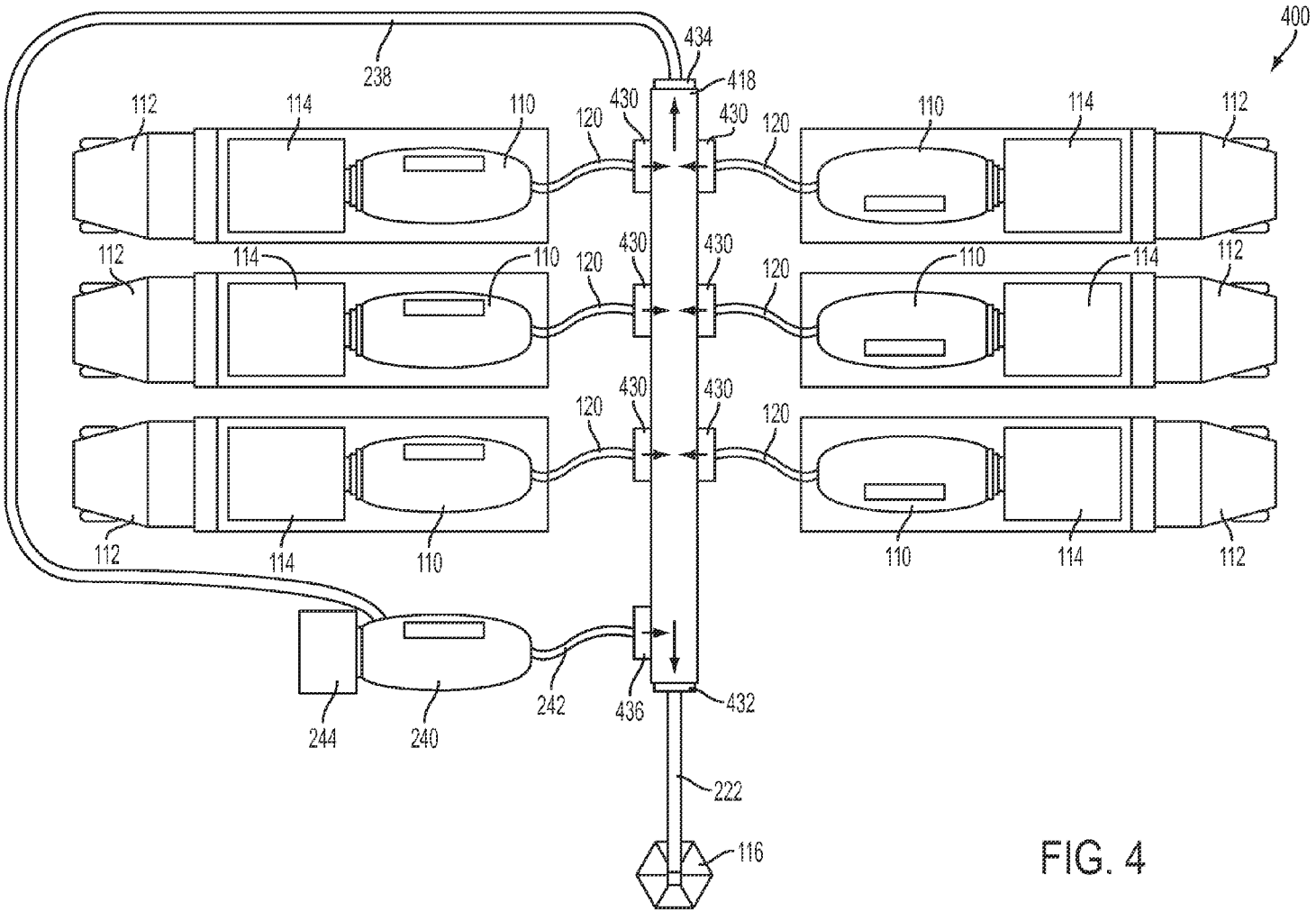
FIG. 4 is another schematic depicting a hydraulic fracturing system that includes the primary pumps and the wellhead of FIG. 1, further includes the supplemental pump of FIG. 2, and further includes a manifold in fluid communication with the supplemental pump and with the primary pumps, according to various embodiments of the present disclosure.

In various pump arrangements described herein, the supplemental pump 240 (FIGS. 2-4) can receive fluid input from the manifold 218 (FIGS. 2 and 3), 418 (FIG. 4). In other words, a portion of the fluid stream pumped into the manifold 218, 418 can be diverted to the supplemental pump 240. In such arrangements, the supplemental pump 240 can receive a portion of the fluid pumped into the system 200, 300, 400 from the primary pumps 110. In various instances, the portion of the fluid stream directed to the supplemental pump 240 can be diverted from the fluid stream before proppants and/or other additives are added to the fluid stream. Accordingly, clogging and/or contamination of the supplemental pump 240 by proppants, for example, can be prevented and/or minimized.

In certain instances 5%-50% of the fluid from the primary pumps 110 can be diverted to the supplemental pump 240. For example, approximately 25% of the fluid from the primary pumps 110 can be diverted to the supplemental pump 240. In other words, as an example, if 80 barrel units were pumped into the manifold 218 (FIGS. 2 and 3), 418 (FIG. 4), 60 barrel units could be directed to the primary outlet 432 as a fluid stream, and 20 barrel units could be directed to the supplemental outlet 434. In other instances, less than 5% or more than 50% of the fluid from the primary pumps 110 can be diverted to the supplemental pump 240.

In various arrangements, the primary pumps 110 can generate a maximum pressure in the manifold 218 (FIGS. 2 and 3), 418 (FIG. 4). For example, when each primary pump 110 is operated to its maximum capacity, a maximum operating pressure $P_{max}$ can be achieved in the manifold 218, 418. Moreover, when a portion of the fluid stream is diverted to the supplemental pump 240, as described herein, the pressure in the manifold 218, 418 may drop. In certain instances, the pressure can drop 5%-50% in the manifold 218, 418. For example, the pressure can drop approximately 25% within the manifold 218, 418. In other instances, the pressure drop can be less than 5% or more than 50%. When the supplemental pump 240 redirects the diverted fluid stream back into the primary fluid stream as a pulse or wave of fluid, the pressure can increase toward the maximum pressure $P_{max}$, for example. In certain instances, the pressure in the fluid stream can approach $P_{max}$, however, the pressure may not reach $P_{max}$ due to frictional losses, for example. For example, the total pressure from the fluid stream in combination with the peak of each pulse can approach $P_{max}$ of the system.

Figure 5:
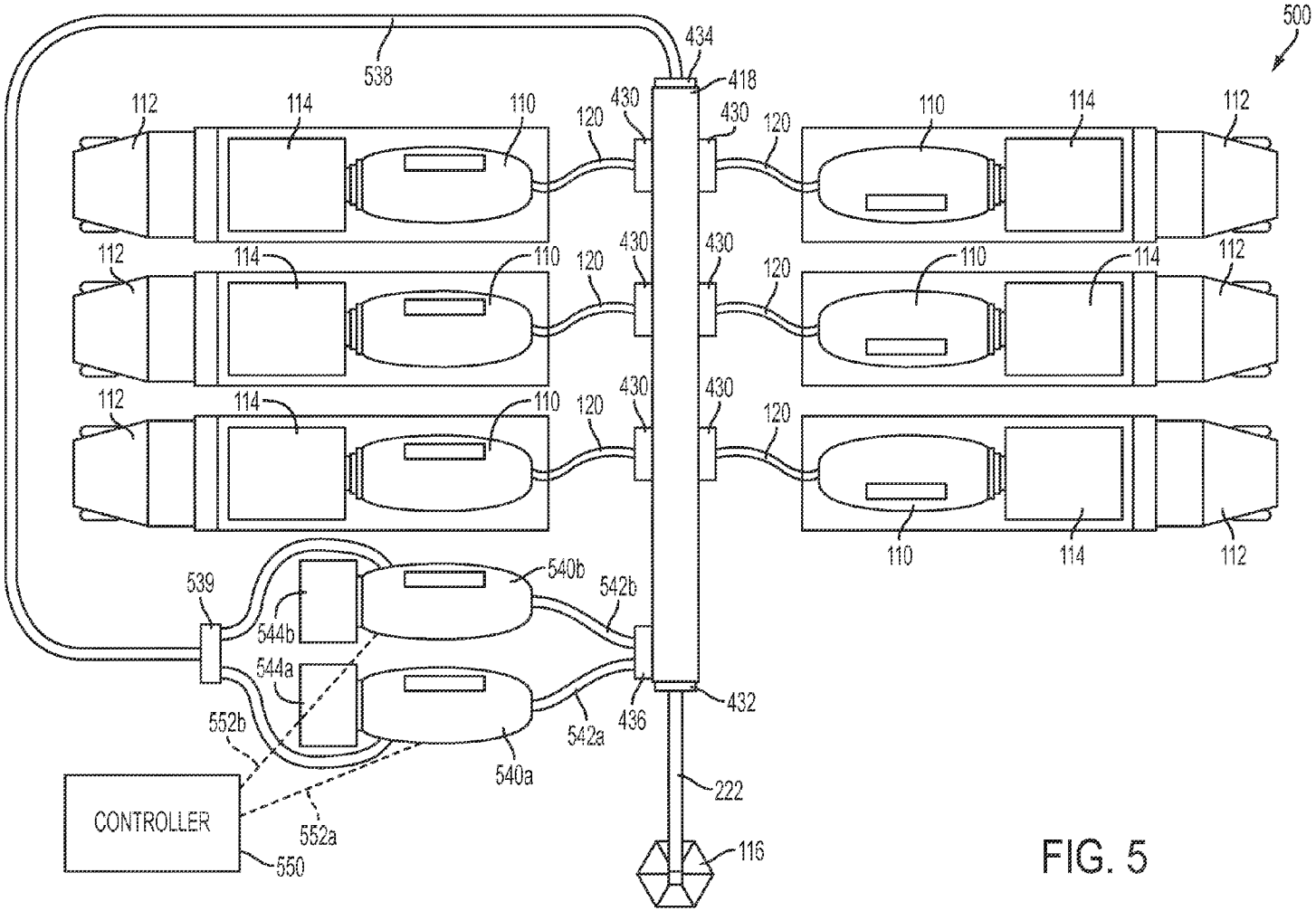
FIG. 5 is another schematic depicting a hydraulic fracturing system that includes the primary pumps and the wellhead of FIG. 1, and further includes the manifold of FIG. 4 and a pair of supplemental pumps, and further depicts the manifold operably in fluid communication with the pair of supplemental pump and with the primary pumps, according to various embodiments of the present disclosure.

In various instances, a hydraulic fracturing system can include one or more supplemental pulse-inducing pumps. A hydraulic fracturing system 500 is depicted in FIG. 5. The depicted hydraulic fracturing system 500 includes the manifold 418, having a plurality of inlets 430 in fluid communication with the primary pumps 110 via the fluid lines 120. The manifold 418 can also include the primary outlet 432 in fluid communication with the wellhead 116 and a supplemental outlet 434 in fluid communication with a pair of supplemental pumps 540*a*, 540*b*. Each pump 540*a*, 540*b* can be coupled to and/or driven by a power unit and/or motor 544*a*, 544*b*, respectively. The manifold 418 depicted in FIG. 5 also includes the supplemental inlet 436 downstream of the primary inlets 430. In the depicted arrangement, a pair of connecting conduits 542*a*, 542*b* extend between the supplemental pumps 540*a*, 540*b*, respectively, and the supplemental inlet 436 such that the pulse or pulses generated by the supplemental pumps 540*a*, 540*b* are directed into the fluid stream at the manifold 418.

In other instances, similar to the system 200, the connecting conduits 542*a*, 542*b* and the primary conduit 222 can be coupled at a supplemental manifold or union intermediate the manifold 218 and the wellhead 116. In still other instances, similar to the system 300, the connecting conduits 542*a*, 542*b* can transmit the pulses to the fluid stream at the wellhead 116. Additionally or alternatively, the connecting conduits 542*a*, 542*b* can be in fluid connection with the fluid stream at different locations downstream of the inlets 230. For example, the first connecting conduit 542*a* can be coupled to the fluid stream upstream of the second connecting conduit 542*b*. Moreover, the system 500 can include additional supplemental pumps. For example, the system 500 can include three or more supplemental, pulse-generating pumps.

Figure 6:
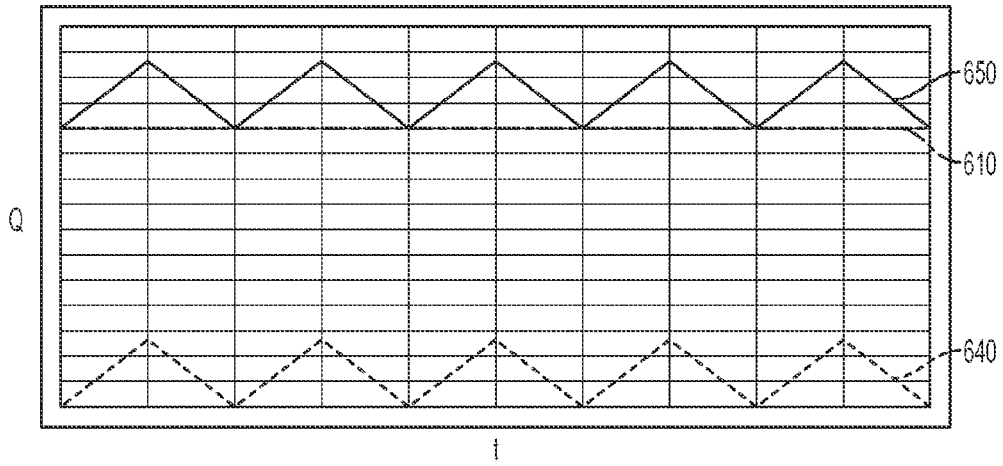
FIG. 6 is a chart depicting the output from a plurality of primary pumps, a pulsed pump, and the aggregated output of the primary and pulsed pumps, according to various embodiments of the present disclosure.

Referring to FIG. 6, an output 610 from an exemplary set of primary pumps, such as the primary pumps 110 (FIGS. 1-5), for example, is depicted. The output 610 comprises a substantially flat and/or constant output and is depicted in FIG. 6 as a horizontal line. A pulsed output 640 from an exemplary supplemental pump, such as supplemental pump 240 (FIGS. 2 and 3) and 440 (FIG. 4), for example, is also depicted in FIG. 6. The pulsed output 640 comprises a plurality of equally spaced, equal amplitude pulses. The combination of the output 610 and the pulsed output 640 is also depicted in FIG. 6. For example, the combined and pulsed output 650 comprises the summation and/or aggregation of the output 610 and the pulsed output 640.

Figure 7:
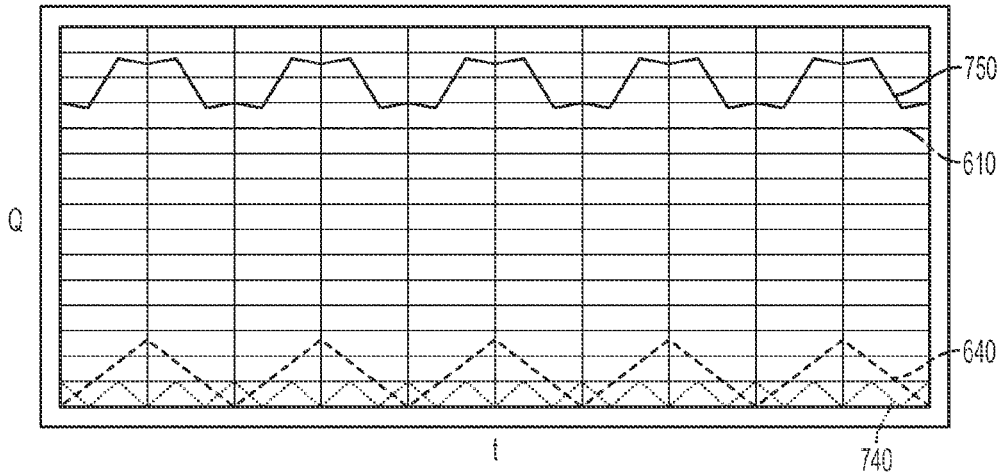
FIG. 7 is a chart depicting the output from a plurality of primary pumps, a pair of pulsed pumps, and the aggregated output of the primary and pulsed pumps, according to various embodiments of the present disclosure.

Referring to FIG. 7, the output 610 is depicted, as well as pulsed outputs 640, 740 from an exemplary pair of supplemental pumps, such as the supplemental pumps 540*a*, 540*b* (FIG. 5), for example. The first pulsed output 640 comprises a plurality of equally spaced, equal amplitude pulses, and the second pulsed output 740 also comprises a plurality of equally spaced, equal amplitude pulses. The pulse amplitude of the first pulsed output 640 can be greater than the pulse amplitude of the second pulsed output 740, for example. For example, the pulse amplitude of the first pulsed output 640 can be 1.5 to 10 times greater than the pulse amplitude of the second pulsed output 740. In the depicted instances, the pulse amplitude of the first pulsed output 640 is 2.5 times greater than the pulse amplitude of the second pulsed output 740.

Figure 8:
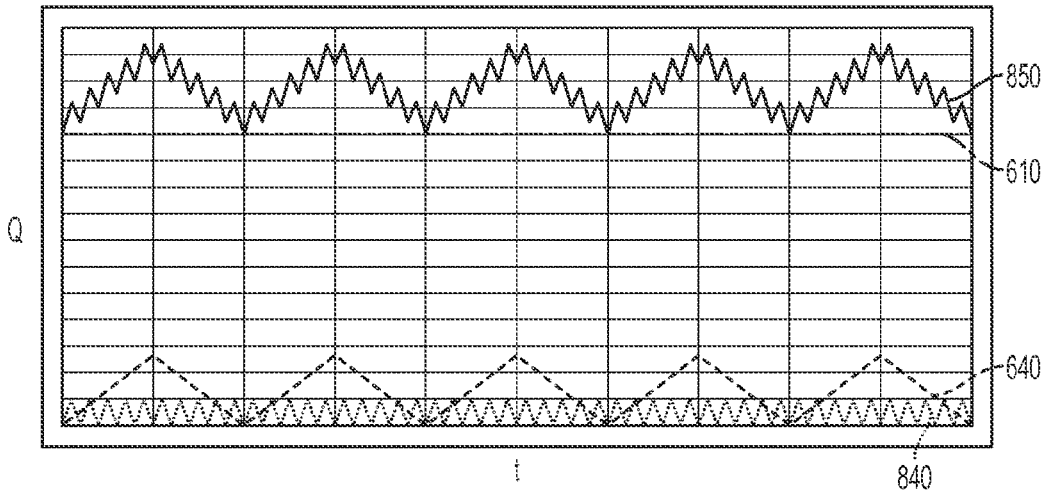
FIG. 8 is a chart depicting the output from a plurality of primary pumps, a pair of pulsed pumps, and the aggregated output of the primary and pulsed pumps, according to various embodiments of the present disclosure.

Additionally or alternatively, the pulse frequency of the second pulsed output 740 can be greater than the pulse frequency of the first pulsed output 640, for example. For example, the pulse frequency of the second pulsed output 740 can be two (2) to ten (10) times greater than the pulse frequency of the first pulsed output 640. In the depicted instances, the pulse frequency of the second pulsed output 740 is three (3) times greater than the pulse frequency of the first pulsed output 640. In other instances, referring to FIG. 8, a second pulsed output 840 comprises a pulse frequency ten (10) times greater than the pulse frequency of the first pulsed output 640. The resultant total output 850 is also depicted in FIG. 8.

Referring again to FIG. 7, in other instances, the pulsed output 640, 740 that has the greater pulse amplitude and/or magnitude can also have the greater pulse frequency. In certain instances, the pulse amplitude of the first and second pulsed outputs 640, 740 can be equal or substantially equal. Additionally or alternatively, in some instances, the pulse frequency of the first and the second pulsed outputs 640, 740 can be equal or substantially equal. For example, the pulse frequency of the first and second pulsed outputs 640, 740 can be equal or substantially equal and the pulse amplitudes of the first and second pulsed outputs 640, 740 can be different. In other instances, the pulse amplitudes of the first and second pulsed outputs 640, 740 can be equal or substantially equal, and the pulse frequencies of the first and second pulsed outputs 640, 740 can be different.

Referring still to FIG. 7, the peaks and/or troughs of the first and second pulsed outputs 640, 740 can be offset. For example, each peak of the first pulsed output 640 can correspond to a trough of the second pulsed output 740. Additionally, each trough of the first pulsed output 640 can correspond to a peak of the second pulsed output 740.

Figure 9:
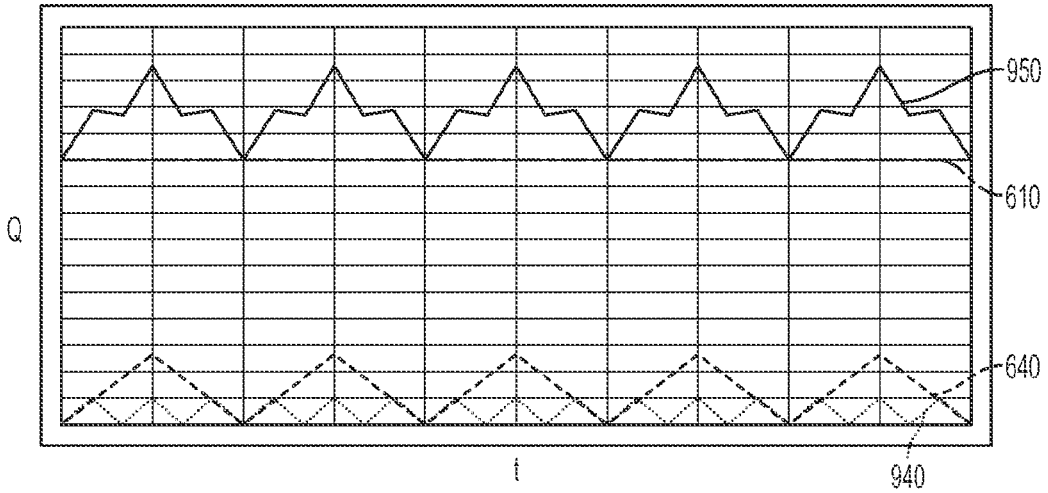
FIG. 9 is a chart depicting the output from a plurality of primary pumps, a pair of pulsed pumps, and the aggregated output of the primary and pulsed pumps, according to various embodiments of the present disclosure.

In other instances, referring now to FIG. 9, various peaks and troughs of the pulsed outputs can be aligned. For example, a second pulsed output 940 can match the second pulsed output 740 of FIG. 7, however, the pulses can be offset by ½ a wavelength. As a result, the peaks of the first pulsed output 640 are aligned with the peaks of the second pulsed output 940, for example, and the troughs of the first pulsed output 640 are aligned with the troughs of the second pulsed output 940, for example. The resultant combined output 950 is also depicted in FIG. 9.

In an exemplary embodiment, referring again to FIG. 5, the first supplemental pump 540 can deliver 5 gallon pulses of fracturing fluid every 0.25 seconds, which can result in pressure pulses of approximately 8000 psi, for example. Additionally or alternatively, the second supplemental pump 540 can deliver 1 gallon pulses of fracturing fluid every 0.125 seconds, which can result in pressure pulses of approximately 5000 psi, for example. The volume, time increment, and pressure changes can be variable and/or adjustable, for example.

In various instances, the supplemental, pulse-inducing pump or pumps of a hydraulic fracturing system can be in signal communication with a controller. For example, referring again to FIG. 5, a controller 550 can transmit signals to the pumps 540*a*, 540*b* along the communication lines 552*a*, 552*b*, respectively. Additionally, an operator can input commands to the controller 550 to affect a pulse and/or sequence of pulses. The commands to the controller 550 can depend on the hydraulic fracturing site and/or conditions. In various instances, the controller 550 can command the supplemental pump or pumps 540*a*, 540*b* to generate periodic pulses of a specific amplitude and at a specific frequency. In other instances, the controller can command the supplemental pump or pumps 540*a*, 540*b* to generate an intermittent pulse of a specific amplitude at a specific time, for example. In instances where multiple, pulse-inducing supplemental pumps are incorporated into a hydraulic fracturing system, each supplemental pump can be independently controlled to different amplitudes, frequencies, and/or times, for example. In other instances, multiple supplemental pumps can be coordinated and/or synchronously controlled.

Figure 10:
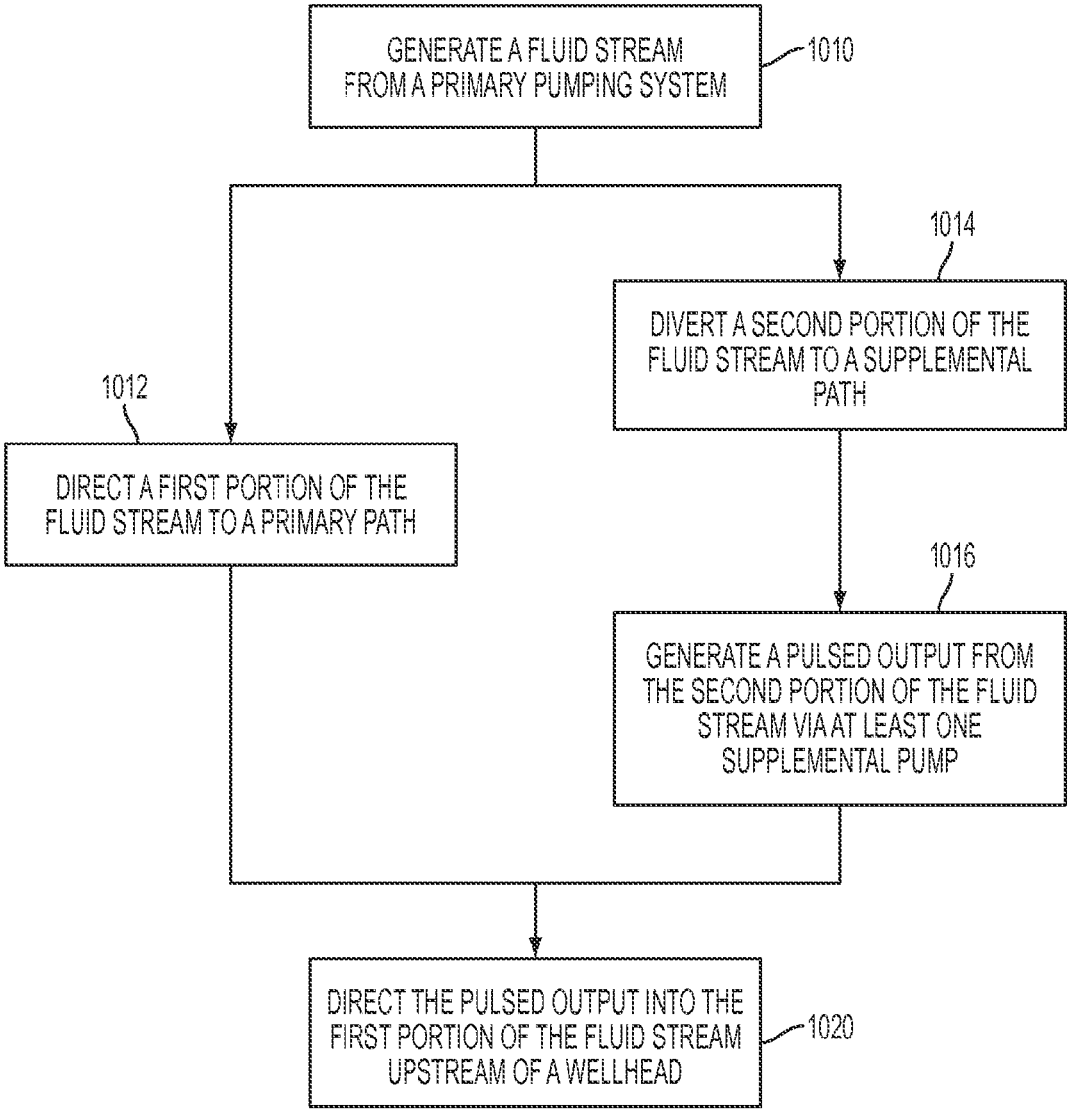
FIG. 10 is a flowchart depicting a hydraulic fracturing method, according to various embodiments of the present disclosure.

Referring now to FIG. 10, a hydraulic fracturing method is disclosed. At step 1010, the method can include generation of a fluid stream from a primary pumping system. For example, the primary pumping system can include a plurality of primary pumps, such as the pumps 110 (FIGS. 1-5), for example, which can pump fluid into a manifold. Thereafter, at step 1012, a first portion of the fluid stream can be directed along a primary path. For example, the first portion of the fluid stream can be directed toward a primary outlet of the manifold. Additionally, a second portion of the fluid stream can be directed along a supplemental path. For example, the second portion of the fluid stream can be directed toward a second outlet, which can be in fluid communication with a supplemental pump, such as supplemental pump 240, 540*a*, and/or 540*b*, for example. In certain instances, step 1012 and 1014 can occur simultaneously. In some instances, step 1014 can occur before step 1012 or vice versa, for example. In various instances, the second portion of the fluid stream can be diverted to the supplemental outlet before proppants and/or other additives are pumped into the fluid stream.

Referring still to FIG. 10, at step 1016 a pulsed output can be generated from the second portion of the fluid stream. For example, a supplemental pumping system can include at least one pulse-inducing pump, which can receive the second portion of the fluid stream via the supplemental outlet and can pump the second portion of the fluid stream to generate a pulse of fluid. In such instances, the pulse or pulses generated at step 1016 can be mechanically induced pulses, which are generated outside of the wellbore. In other words, the pulses of fluid are generated upstream of a wellhead, such as the wellhead 116 (FIGS. 1-5), for example.

At step 1020, the pulsed output from the supplemental pump system can be directed into the first portion of the fluid stream. For example, the pulsed output can be pumped into the first portion of the fluid stream at the manifold, at the wellhead, and/or between the manifold and the wellhead. As a result, the combined fluid stream can enter the wellhead and be forced down the wellbore and into the formation.

Throughout the steps 1010, 1012, 1014, 1016 and 1020 described above, a monitoring unit can monitor the fluid stream from the primary pumping system and the supplemental pumping system. Moreover, a controller can control the primary and/or supplemental pumps throughout the steps 1010, 1012, 1014, 1016 and 1020. For example, the pulsing sequences, including frequency and/or amplitude, for example, can be adjusted throughout the process.

The reader will appreciate that the various hydraulic fracturing systems and methods described herein can be employed in new wells and can be utilized at previously drilled wells to draw out additional oil and/or gas, for example. Additionally, the systems and methods described herein can employ various pumps simultaneously and/or separately. In various instances, it may be advantageous to exclusively employ the supplemental pump(s) described herein for at least a portion of a hydraulic fracturing operation. In such instances, the entire fluid stream from the primary pumps 110 can be diverted to a supplemental pump or pumps.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While the hydraulic fracturing systems and/or methods have been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

I claim:

1. A hydraulic fracturing system, comprising:

a manifold, comprising:

a first fluid outlet;

a second fluid outlet; and a plurality of fluid inlets;

a plurality of primary pumps, wherein each of the primary pumps is fluidically coupled to one of the fluid inlets, wherein the primary pumps are configured to deliver a first fluid stream to the first fluid outlet, and wherein the primary pumps are configured to deliver a second fluid stream to the second fluid outlet; and a supplemental pump fluidically coupled to the second fluid outlet, wherein the supplemental pump is configured to deliver pulses of fluid to the first fluid stream.

2. The hydraulic fracturing system of claim 1, wherein the manifold further comprises a supplemental inlet, and wherein the supplemental pump is fluidically coupled to the supplemental inlet.

3. The hydraulic fracturing system of claim 1, further comprising a conduit extending from the first outlet to a wellhead.

4. The hydraulic fracturing system of claim 3, wherein the supplemental pump is fluidically coupled to the conduit.

5. The hydraulic fracturing system of claim 3, wherein the supplemental pump is fluidically coupled to the wellhead.

6. The hydraulic fracturing system of claim 1, wherein the supplemental pump comprises a first supplemental pump, wherein the hydraulic fracturing system further comprises a second supplemental pump fluidically coupled to the second fluid outlet, and wherein the second supplemental pump is configured to deliver pulses of fluid to the first fluid stream.

7. The hydraulic fracturing system of claim 6, further comprising a controller in signal communication with the first supplemental pump and the second supplemental pump.

8. The hydraulic fracturing system of claim 6, wherein the first supplemental pump is configured to deliver pulses of a first magnitude at a first frequency, and wherein the second supplemental pump is configured to deliver pulses of a second magnitude at a second frequency.

9. The hydraulic fracturing system of claim 8, wherein the first magnitude is different than the second magnitude.

10. The hydraulic fracturing system of claim 8, wherein the first frequency is different than the second frequency.

11. The hydraulic fracturing system of claim 1, wherein the fluid stream comprises hydraulic fracturing fluid.

12. The hydraulic fracturing system of claim 1, wherein each primary pump comprises a piston pump.

13. The hydraulic fracturing system of claim 1, further comprising a plurality of motors operably coupled to the primary pumps and the supplemental pump.

14. A hydraulic fracturing system, comprising:

a manifold, comprising:

a first fluid outlet;

a second fluid outlet; and a fluid inlet;

a primary pump fluidically coupled to the fluid inlet, wherein the primary pump is configured to deliver a fluid stream to the manifold, wherein a first portion of the fluid stream is directed toward the first fluid outlet, and wherein a second portion of the fluid stream is directed toward the second fluid outlet;

a supplemental pump fluidically coupled to the second fluid outlet, wherein the supplemental pump is configured to receive the second portion of the fluid stream and generate pulses of fluid in the second portion of the fluid stream, and wherein the pulses are delivered to the first portion of the fluid stream; and a controller in signal communication with the supplemental pump, wherein the controller is configured to control the pulses of fluid from the supplemental pump.

15. The hydraulic fracturing system of claim 14, wherein the supplemental pump comprises a first supplemental pump, and wherein the hydraulic fracturing system further comprises a second supplemental pump arranged in parallel with the first supplemental pump.

16. The hydraulic fracturing system of claim 15, further comprising a controller in signal communication with the first supplemental pump and the second supplemental pump.

17. The hydraulic fracturing system of claim 16, wherein the first supplemental pump is configured to deliver pulses of a first magnitude at a first frequency, and wherein the second supplemental pump is configured to deliver pulses of a second magnitude at a second frequency.

18. The hydraulic fracturing system of claim 17, wherein the first magnitude is different than the second magnitude, and wherein the first frequency is different than the second frequency.

19. A hydraulic fracturing method comprising:

generating a fluid stream from a primary pumping system;

directing a first portion of the fluid stream to a primary fluid path;

diverting a second portion of the fluid stream to a supplemental fluid path;

generating a pulsed output from the second portion of the fluid stream;

directing the pulsed output into the first portion of the fluid stream upstream of a wellhead; and controlling a supplemental pumping system that is configured to generate the pulsed output from the second portion of the fluid stream.

* * * * *